US009145683B2

(12) United States Patent
Matys

(10) Patent No.: US 9,145,683 B2
(45) Date of Patent: Sep. 29, 2015

(54) PREFABRICATED PILLAR SLAB SYSTEM

(71) Applicant: Risi Stone Inc., Thornhill (CA)

(72) Inventor: Tyler Matys, Newmarket (CA)

(73) Assignee: Risi Stone Inc, Thornhill (CA)

( * ) Notice: Subject to any disclaimer, the term of this patent is extended or adjusted under 35 U.S.C. 154(b) by 0 days.

(21) Appl. No.: 14/051,952

(22) Filed: Oct. 11, 2013

(65) Prior Publication Data

US 2015/0096254 A1 Apr. 9, 2015

(30) Foreign Application Priority Data

Oct. 7, 2013 (CA) ..... 2829672

(51) Int. Cl.
*E04C 1/00* (2006.01)
*E04C 3/34* (2006.01)
*B44F 9/04* (2006.01)

(52) U.S. Cl.
CPC ... *E04C 3/34* (2013.01); *B44F 9/04* (2013.01); *E04C 1/00* (2013.01)

(58) Field of Classification Search
USPC ..... 52/169.1, 169.3, 169.4, 169.9, 295, 52/781.5, 781.3, 592.6, 284, 503–506, 98, 52/100, 604–607, 770, 745.18, 745.2; 405/286; 256/19, 24; 446/117, 446/124–125
See application file for complete search history.

(56) References Cited

U.S. PATENT DOCUMENTS 989,677 A * 4/1911 Wiederholdt ..... 52/100
1,649,367 A * 11/1927 Reagan ..... 52/100
2,737,801 A * 3/1956 Barnhart ..... 52/100
2,951,318 A * 9/1960 Sedlak ..... 52/100
3,298,668 A * 1/1967 Schueren ..... 256/19
3,385,012 A * 5/1968 Lovegreen ..... 52/21
3,905,170 A * 9/1975 Huettemann ..... 52/591.1
4,426,815 A * 1/1984 Brown ..... 52/100
4,815,243 A * 3/1989 Pardo ..... 52/100
4,887,403 A * 12/1989 Bonner ..... 52/286
4,944,124 A * 7/1990 Armstrong ..... 52/169.12
5,098,328 A * 3/1992 Beerens ..... 446/128
5,361,977 A * 11/1994 Ogrodnick, Jr. ..... 232/39
5,623,797 A * 4/1997 Gravier et al. ..... 52/284
5,761,861 A * 6/1998 Brackett ..... 52/218
5,934,035 A * 8/1999 Rasmussen et al. ..... 52/300
5,960,604 A * 10/1999 Blanton ..... 52/604
6,038,822 A * 3/2000 Keys ..... 52/100
6,065,265 A * 5/2000 Stenekes ..... 52/607
6,082,057 A * 7/2000 Sievert ..... 52/100
6,185,888 B1 * 2/2001 Wasson ..... 52/300
6,189,282 B1 * 2/2001 VanderWerf ..... 52/582.1
6,287,054 B1 * 9/2001 Egan et al. ..... 405/262
6,543,969 B1 * 4/2003 Adam ..... 405/284
6,571,521 B1 * 6/2003 Ameigh ..... 52/295
6,651,401 B2 * 11/2003 Price et al. ..... 52/604

(Continued)

*Primary Examiner* — Beth Stephan
(74) *Attorney, Agent, or Firm* — Duane Morris LLP

(57) ABSTRACT

A pillar slab system using precast concrete pillar slabs for constructing a pillar, pergola or other stone structure comprises a body comprising at least four sides. Each exterior side surface comprises at least one simulated stone face. At least first and second side surfaces also have at least one simulated joint defining a visual separation between simulated stone faces. The simulated joints in the side surfaces are disposed at different horizontal positions, so that when one pillar slab is stacked on an identical pillar slab in a different orientation, the simulated joints in adjacent surfaces are vertically staggered relative to one another to avoid obvious repeating patterns and provide the appearance of a natural stone construction.

10 Claims, 26 Drawing Sheets

(56) References Cited

U.S. PATENT DOCUMENTS

| | | | | |
|---|---|---|---|---|
| 6,681,542 | B2 * | 1/2004 | Pribyl | 52/606 |
| 6,827,073 | B1 * | 12/2004 | Morrell | 125/23.01 |
| 6,854,220 | B2 * | 2/2005 | Dueck et al. | 52/100 |
| 7,503,730 | B2 * | 3/2009 | Price | 405/286 |
| 2003/0089068 | A1 * | 5/2003 | Ameigh | 52/606 |
| 2004/0221538 | A1 * | 11/2004 | Thorpe | 52/596 |
| 2005/0252146 | A1 * | 11/2005 | MacDonald et al. | 52/606 |
| 2008/0047219 | A1 * | 2/2008 | Donohew | 52/603 |
| 2008/0060312 | A1 * | 3/2008 | Hung | 52/596 |
| 2009/0120023 | A1 * | 5/2009 | Hoggan et al. | 52/300 |
| 2011/0265399 | A1 * | 11/2011 | Hahn | 52/173.1 |
| 2011/0283657 | A1 * | 11/2011 | Barrett et al. | 52/834 |

* cited by examiner

PREFABRICATED PILLAR SLAB SYSTEM

FIELD OF THE INVENTION

This invention relates to masonry structures. In particular, this invention relates to a system for constructing pillars and the like using precast concrete elements.

BACKGROUND OF THE INVENTION

Pillars have always been popular vertical elements in landscape design. Pillars are often made of stone or precast concrete, which as construction materials have extremely high durability and resistance to the elements. A pillar can be incorporated into another vertical element, for example forming the end of a seat wall or fence; or can stand alone, for example supporting a horizontal element such as a pediment or other roof structure, or an elevated deck. A pillar can thus serve as a structural support and/or as an aesthetic element in landscaping and building construction applications.

Conventionally the two most common methods of constructing a pillar are:

1) Laying individual masonry units such as stones or precast concrete elements in a pattern to form the basic shape desired, which is typically square or rectangular in cross-section. Each subsequent course is laid over the immediately preceding finished course, with the pattern of joints being repeated or a variation of it used, while maintaining consistent outside dimensions. It is desirable from a structural point of view to have the elements overlapping on the next subsequent course, in order to tie the individual units together to create a coherent structure. However, each individual unit within a course must be leveled independently, which is time consuming, and then fit together with adjacent elements and subsequent courses. The process of laying and stacking the individual masonry units is thus time-consuming, and generally difficult enough to require a skilled artisan such as a mason to ensure that the pillar dimensions are maintained through each course and the desired aesthetic appeal is achieved in the finished pillar.

2) Constructing the core of the pillar with concrete elements such as cinder blocks, reinforced with mortar and reinforcing steel, and then facing the resulting structural pillar core with stone and mortar, brick, stucco, or some other facing material to provide a desired aesthetic finish. However, the process of constructing the pillar core requires labourers who are skilled in block construction, mortar, and reinforcement techniques. Furthermore, the core structure must be left to cure and solidify before beginning to face the core exterior, which prolongs the pillar construction process, and the facing itself requires mortar or expensive adhesives which require additional time to cure.

It would accordingly be advantageous to provide a pillar construction system that eliminates one or more of the disadvantages of conventional pillar construction techniques.

BRIEF DESCRIPTION OF THE DRAWINGS

In drawings which illustrate by way of example only a preferred embodiment of the invention.

DETAILED DESCRIPTION OF THE INVENTION

Figure 1:
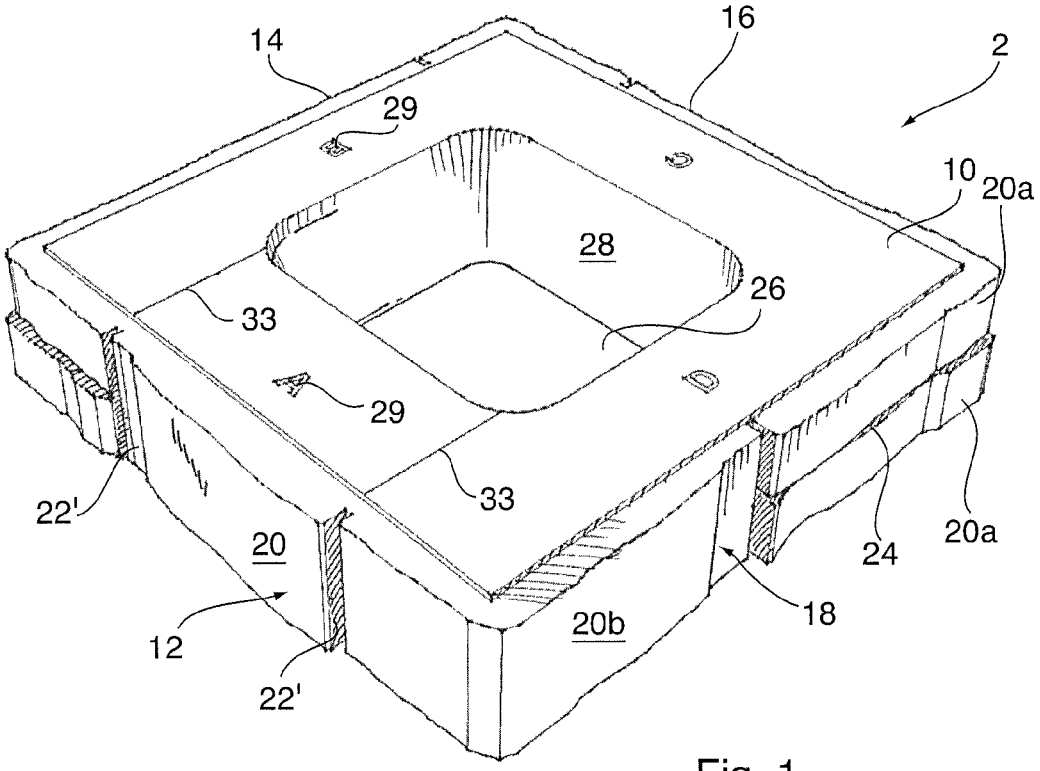
FIG. 1 is a perspective view of a pillar slab according to the invention.
Figure 2:
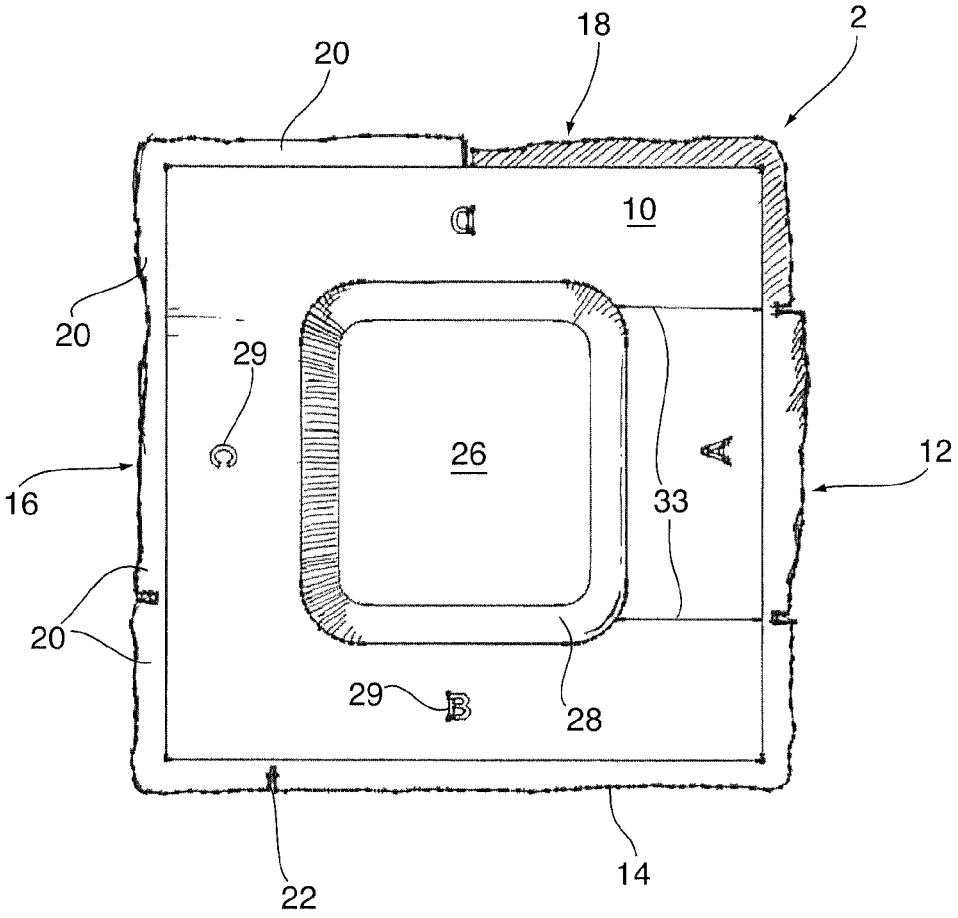
FIG. 2 is a top plan view of the pillar slab of FIG. 1.
Figure 3:
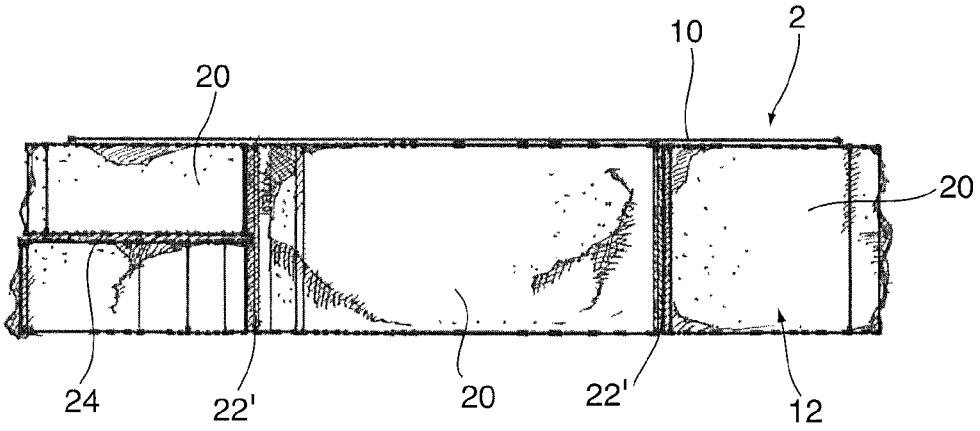
FIG. 3 is a side elevation of a first side of the pillar slab of FIG. 1.
Figure 4:
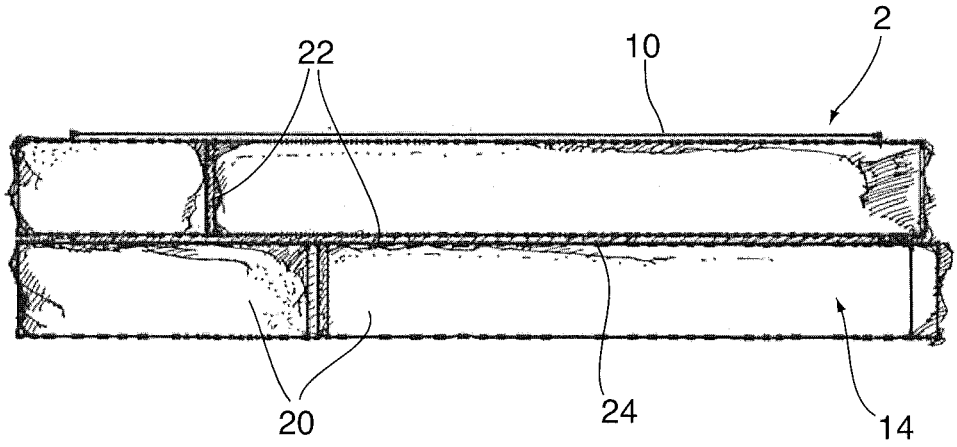
FIG. 4 is a side elevation of a second side of the pillar slab of FIG. 1.
Figure 5:
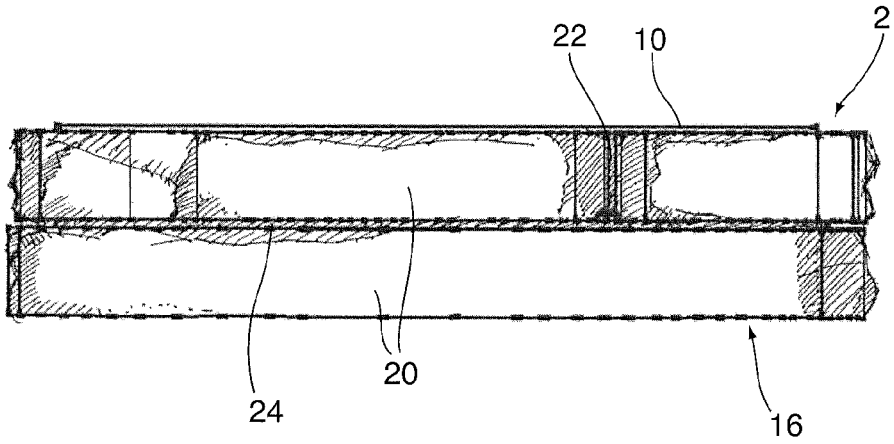
FIG. 5 is a side elevation of a third side of the pillar slab of FIG. 1.
Figure 6:
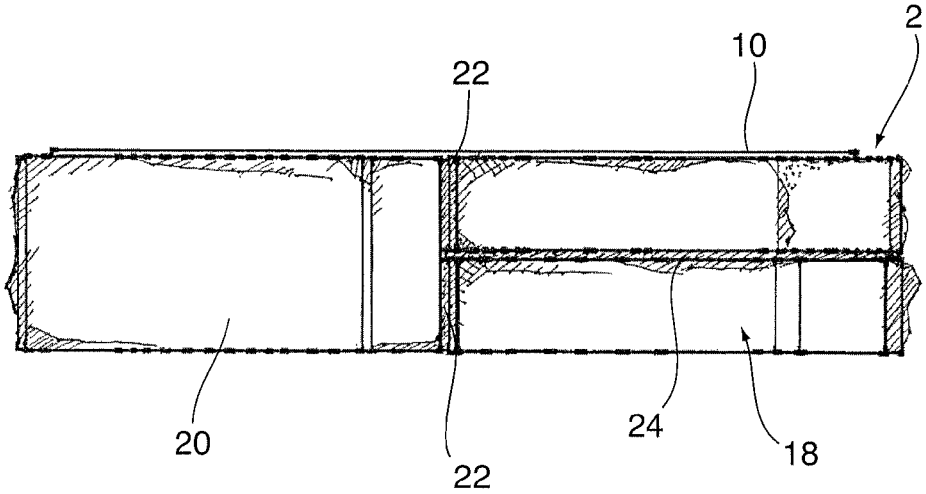
FIG. 6 is a side elevation of a fourth side of the pillar slab of FIG. 1.

The invention eliminates one or more of the disadvantages of prior art pillar construction techniques. By providing a pillar element or "slab" as a unitary complete pillar course, the system of the invention avoids the time-consuming process of fitting together and stacking many different sizes of masonry units, significantly reduces the time required to construct a pillar, and eliminates the need for skilled or semi-skilled labour in the pillar construction process.

Using simulated joints defining simulated stone faces according to the invention, a pillar can be constructed having the appearance of multiple smaller, randomly-sized, natural stone pillar units laid in a course and overlapping each other. Moreover, according to the present invention a pillar can be constructed using a plurality of identical slabs for each course, while avoiding obvious repeating patterns in the pillar faces which would tend to detract from the 'natural stone' look of the exterior pillar surface. Each pillar slab is much easier to level than the multiple units which form a course in a conventionally-constructed pillar. Forming the pillar slab as a single unit also helps to spread the load of the pillar more uniformly over a leveling pad or foundation than individual blocks forming a pillar course.

A pillar according to the invention can thus be constructed in a fraction of the time it takes to construct a pillar using conventional techniques, saving both time and cost, and ensuring an aesthetically pleasing natural finished appearance. A pillar slab according to the invention can be formed by pouring wet concrete into a flexible mold, allowing the concrete to cure for the required period of time, and then demolding the pillar slab, and is thus easily manufactured in quantity. In the preferred embodiment the pillar slab also provides an easy means of incorporating other structures into the pillar.

Other advantages of the preferred embodiments will be apparent from the description which follows, it being understood that the various advantages of the invention may apply to one or more embodiments, but not necessarily to every embodiment.

The present invention thus provides a pillar slab system comprising precast concrete pillar slabs for constructing a pillar, each pillar slab comprising a body comprising at least four sides, each side comprising an exterior side surface, each exterior side surface comprising at least one simulated stone face, at least first and second side surfaces comprising at least one simulated vertical joint defining a visual separation between simulated stone faces, the at least one simulated vertical joint in the first side surface being disposed at a different horizontal position than the at least one simulated vertical joint in the second side surface, whereby when an upper pillar slab is stacked on an identical lower pillar slab and oriented such that the first side surface in the upper pillar slab is disposed above the second side surface in the lower pillar slab, the simulated vertical joints in at least the first and second side surfaces are laterally staggered relative to one another so that the first and second side surfaces have different arrangements of simulated stone faces.

The present invention further provides a mold for casting a pillar slab comprising a body comprising at least four sides, each side comprising an exterior side surface, each exterior side surface comprising at least one simulated stone face, at least first and second side surfaces comprising at least one simulated vertical joint defining a visual separation between simulated stone faces, the at least one simulated vertical joint in the first side surface being disposed at a different horizontal position than the at least one simulated vertical joint in the second side surface, the mold comprising: a mold body comprising at least four sides, each side comprising an interior side surface, each interior side surface comprising a negative of at least one simulated stone face, at least first and second side surfaces comprising a negative of at least one simulated vertical joint defining a visual separation between simulated stone faces, the negative of the at least one simulated vertical joint in the first side surface being disposed at a different horizontal position than the negative of the at least one simulated vertical joint in the second side surface.

The present invention further provides a method of constructing a pillar formed in whole or in part of substantially identical pillar slabs each comprising a body comprising at least four sides, each side comprising an exterior side surface, each exterior side surface comprising at least one simulated stone face, at least first and second side surfaces comprising at least one simulated vertical joint defining a visual separation between simulated stone faces, the at least one simulated vertical joint in the first side surface being disposed at a different horizontal position than the at least one simulated vertical joint in the second side surface, comprising the steps of: a. laying a first pillar slab, and b. laying at least a second pillar slab over the first pillar slab in a rotationally different orientation from the first pillar slab, whereby the simulated vertical joints in the first pillar slab are laterally staggered relative to the simulated vertical joints in the second pillar slab so that different arrangements of simulated stone faces are disposed one above the other.

One embodiment of a pillar slab 2 for a pillar slab system according to the invention is illustrated in FIGS. 1 to 7. The pillar slab 2 of the invention will be described in the context of a pillar, pergola or similar structure. However, it will be appreciated that the pillar slab 2 of the invention can be readily adapted to create other self-standing or supported vertical structures, including without limitation planters, fire pits, chimneys and the like.

The pillar slab 2 comprises a body 10, in the embodiment illustrated comprising four sides 12, 14, 16 and 18. It will be appreciated that the body 10 may comprise more than four sides, for example for aesthetic purposes. However, preferably the pillar slab 2 is formed as a regular polygon in cross-section, which will afford the optimal ability to avoid obvious repeating patterns, as will be apparent from the description below.

Each side of the pillar slab 2 comprises an exterior side surface 12, 14, 16 or 18 having at least one simulated stone face 20. In the preferred embodiment all of the exterior side surfaces comprise a plurality of simulated stone faces 20, separated by a simulated vertical joint 22 which defines a visual separation between laterally adjacent simulated stone faces 20, and/or a simulated horizontal joint 24 which defines a visual separation between vertically adjacent simulated stone faces 20. Hereinafter the terms "stone faces" and "joints" will be used to describe the simulated stone faces 20 and simulated joints 22, 24, however it will be appreciated that because the pillar slab 2 of the invention is in the preferred embodiment formed from precast concrete, the stone faces 20 and joints 22, 24 are simulated surface features.

The pillar slab 2 can be formed to any outside dimension. A landscape pillar for example commonly has outside dimensions of between 20"×20" (500 mm×500 mm) and 22"×22" (560 mm×560 mm), although larger or smaller pillars are possible. The thickness of the pillar slab 2 is equal to the maximum desired height of the largest "individual" stone face 20 plus the height of a horizontal joint 24.

A natural stone pillar might use a "standard" stone thickness and a "double-high" stone thickness, also known as a "jumper" unit, to provide variation in the finished pillar. A pillar slab 2 according to the invention may thus comprise stone faces 20 of different heights, for example a standard stone face 20*a* and a double-high stone face 20*b*, to reproduce the look of a natural stone course. In these embodiments the pillar slab 2 is formed to a thickness that will accommodate the double-high or "jumper" stone face 20*b*. For example, in the embodiment of FIGS. 1 to 7 side surface 18 comprises two standard stone faces 20*a* separated by a horizontal joint 24, which simulate two 'courses' of natural stone laid one over the other, and a double-high stone face 20*b* which is cast so as to simulate a "jumper" stone traversing the two simulated courses. One or more sides 12, 14, 16, 18 of the pillar slab 10 may have only standard-height stone faces 20*a*, or only double-high stone faces 20*b*, or any combination thereof. Also, the pillar slab 2 may be formed with any number of simulated courses as an alternative to the two simulated courses in the embodiment illustrated. The simulation of two (or more) courses of natural stone in the pillar slab 2 provides the advantage of greater structural integrity, because of the increased thickness of the pillar slab 2 in comparison to a pillar slab simulating only a single course of natural stone, without jumper stones. However, the pillar slab 2 can be formed to simulate a single course of standard-height stone, using reinforcing members such as rebar if necessary.

In a natural stone pillar, the stones in each successive course are staggered so as to overlap two stones and overlay the joints in the adjacent lower course. This imparts structural integrity to the pillar. Therefore, in order to simulate a natural stone pillar, the simulated stone faces 20 according to the invention similarly overlap two stone faces 20 and overlay the vertical joints 22 in the adjacent lower course, as a general rule (where two stacked standard-height stone faces 20*a* are adjacent to a double-high stone face 20*b*, the joint 22 separating the standard-height stone faces 20*a* from the double-high stone face 20*b* necessarily traverses two courses).

Thus, according to the invention, at least some of the exterior side surfaces 12, 14, 16, 18 have different patterns of stone faces 20 and joints 22. For example, comparing sides 12, 14, 16 and 18 in FIGS. 3, 4, 5 and 6, respectively, it can be seen that within each exterior side surface the vertical joints 22 are disposed at a different horizontal position than the vertical joints 22 in the other side faces. The appearance of each side surface is designed to both blend the individual stone faces 20 within the side surface and blend the pillar slabs 2 within the pillar.

Figure 9:
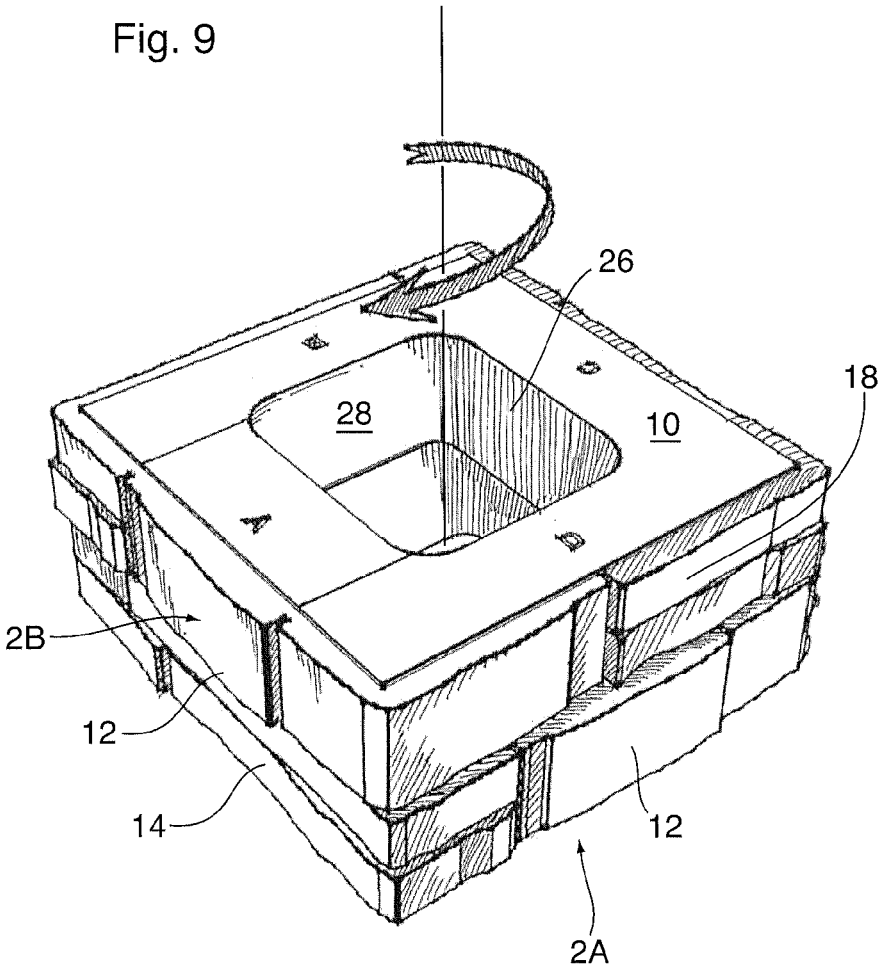
FIG. 9 is a perspective view of a partially constructed pillar using the pillar slab of FIG. 1.

If two identical pillar slabs 2 as illustrated in FIG. 1 were stacked one on top of the other in the same orientation, i.e. so that sides 12, 14, 16 and 18 in the upper slab 2 are disposed above sides 12, 14, 16 and 18 in the immediately lower slab 2, vertical joints 22 would be in vertical alignment and a repeating pattern would be apparent, so the appearance of the resulting pillar would be unnatural. However, if the same two identical pillar slabs 2 of FIG. 1 are stacked one on top of the other in different orientations, for example so that side 12 in the upper slab 2 is aligned over side 14 in the lower slab 2, as illustrated in FIG. 9, then the vertical joints 22 in each pillar slab 2 will be out of vertical alignment and each stone face 20 in the upper pillar slab 2 would overlap two stone faces 20 in the lower pillar slab 2, simulating the appearance of a natural stone pillar.

Figure 7D:
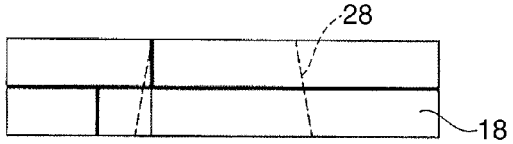
FIGS. 7A to 7D are schematic side elevations of the four sides of the pillar slab of FIG. 7 showing the hollow core wall in phantom.
Figure 7C:
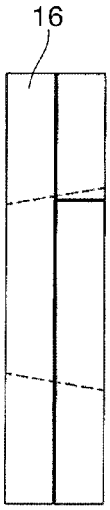
Figure 7:
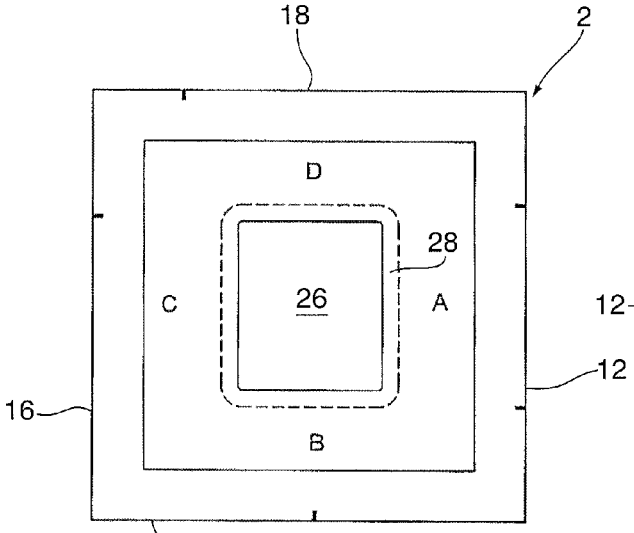
FIG. 7 is a schematic bottom plan view of the pillar slab of FIG. 1.
Figure 7A:
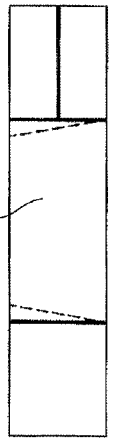
Figure 7B:
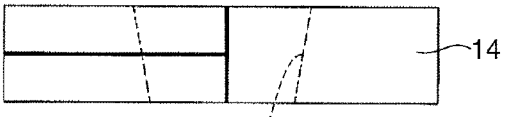

According to a preferred embodiment of the invention, the exterior side surfaces 12, 14, 16, 18 of the pillar slab 2 are each designed with different patterns of stone faces 20 and joints 22, whereby the vertical joints 22 are in different horizontal positions on each side, so that the vertical joints 22 in successive courses are out of vertical alignment, or vertically staggered, relative to one another. This produces the appearance of natural stone courses when vertically adjacent pillar slabs 2 are laid in different orientations. For a realistic natural look, the pattern on any particular side surface, for example side surface 12, must also tie into the patterns on the side surfaces 14, 18 on either side. This means that the pattern of horizontal joints 24 on any one side surface must continue through to the connected side surfaces, as shown in FIG. 7. This provides the realism needed for simulated stone faces 20 to appear as solid unitary elements, and design continuity.

To achieve the look of a natural stone construction according to the invention, it is possible to provide two different patterns having vertical joints 22 in different horizontal positions, on opposite sides of the pillar slab 2. By rotating each successively laid pillar slab 2 90 degrees relative to the vertically adjacent pillar slab 2, no adjacent courses will have the same pattern of stone faces 20 and joints 22, and the joints 22 will appear to be vertically staggered. This could apply for example in the case of a rectangular pillar having different depth and width dimensions, where there are only two possible orientations for each pillar slab 2.

However, in the preferred embodiment illustrated, the pillar slab 2 is square and all four of the exterior side surfaces 12, 14, 16, 18 have different patterns of stone faces 20 and vertical joints 22, the joints 22 being disposed in different horizontal positions along each side surface. The pillar slab 2 of FIG. 1, by way of example, provides the optimal versatility in combining patterns between adjacent pillar slabs 2 so as to avoid obvious repeating patterns. The pillar slab 2 can be laid so that any of three sides of one pillar slab 2 overlays the fourth side of the vertically adjacent pillar slab 2, and the vertical joints 22 will be vertically staggered, simulating the overlapping stones of a natural pillar. FIG. 9 for example illustrates side 18 of pillar slab 2D overlaying side 12 of pillar slab 2A, by laying pillar slab 2D in an orientation that is rotationally offset from slab 2A by 90 degrees. To assist in orienting vertically adjacent pillar slabs 2 to avoid repeating patterns, indicators 29 may be provided, for example on the top surface of the body 10 as shown in FIG. 1, allowing workers to more easily identify the correct orientation of the pillar slabs 2 as they are being laid.

Figure 8:
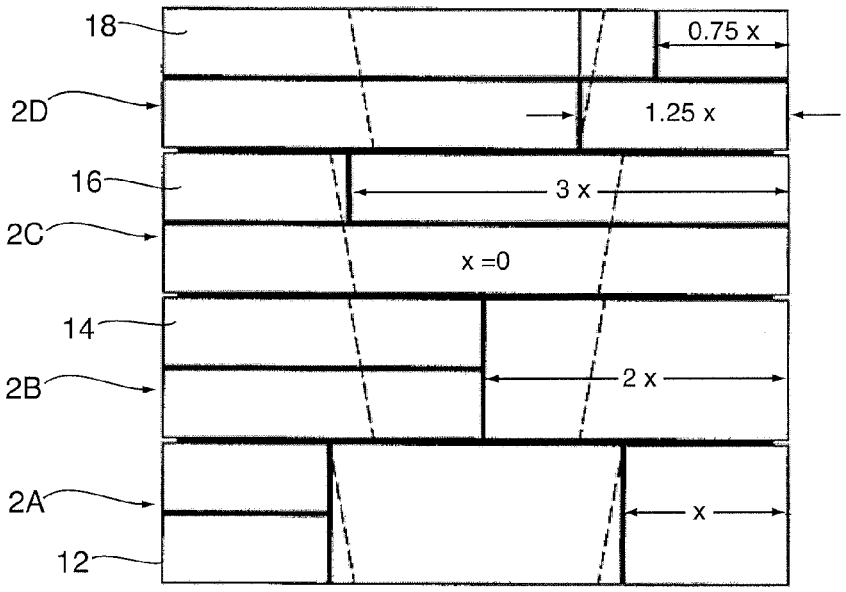
FIG. 8 is a schematic front elevation of four courses of a pillar constructed using the pillar slab of FIG. 1.
Figure 10:
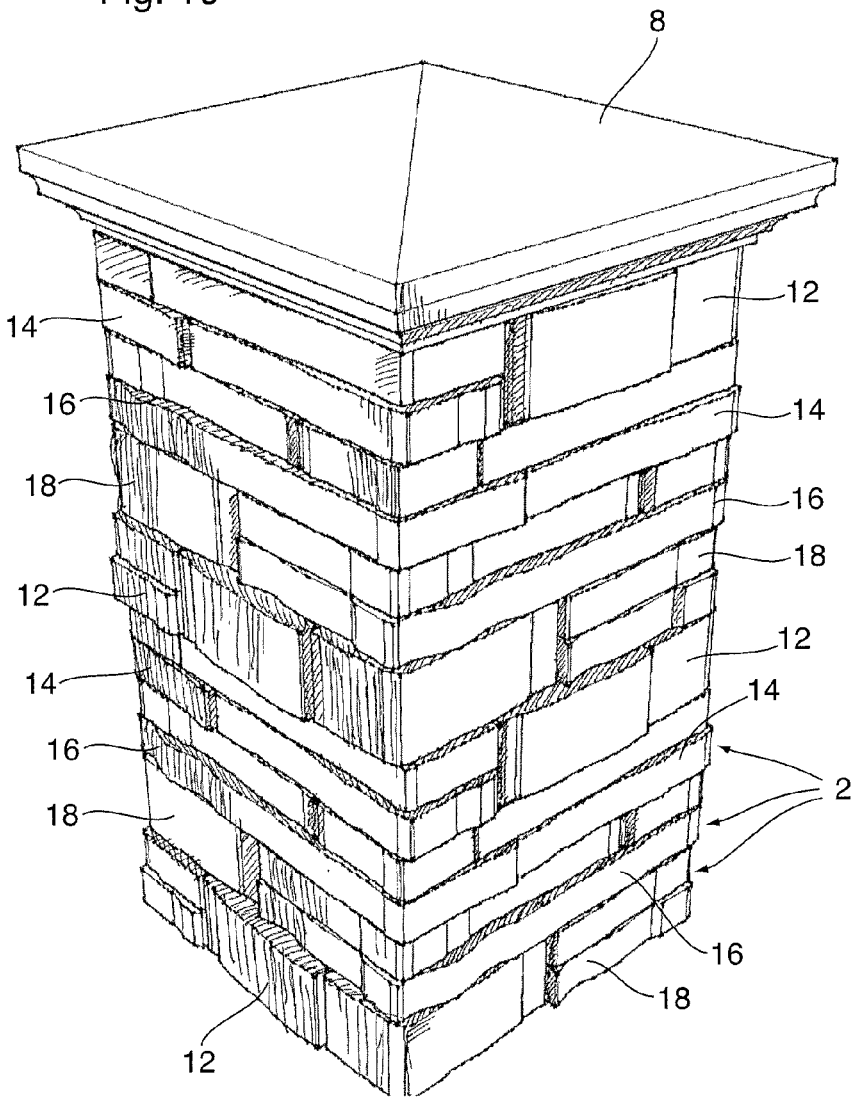
FIG. 10 is a perspective view of a fully constructed pillar using the pillar slab of FIG. 1.

FIG. 8 illustrates four courses of a pillar constructed from four identical pillar slabs 2 of FIG. 1. In this embodiment, illustrated solely by way of example, side 12 is provided with a vertical joint 22 disposed at a horizontal distance x from the right-hand side edge of the pillar slab 2A; side 14 is provided with a vertical joint 22 disposed at a horizontal distance 2× from the right-hand side edge of the pillar slab 2B; side 16 is provided with a vertical joint 22 disposed at a horizontal distance 3× from the right-hand side edge of the pillar slab 2C; and side 18 is provided with a vertical joint 22 disposed at a horizontal distance 1.25× from the right-hand side edge of the pillar slab 2D. The pillar slabs 2A, 2B, 2C and 2D are respectively oriented so that sides 12, 14, 16 and 18 respectively lie along the front face of the pillar. Thus, amongst the four pillar slabs 2A, 2B, 2C and 2D, there are no vertical joints 2 in vertical alignment. Laying the next four pillar slabs 2 on top of the courses shown and repeating the respective orientations illustrated in FIG. 8, the same pattern will repeat only every fifth pillar slab 2, as shown in FIG. 10. The separation between repeating patterns is large enough that even a trained eye would have difficulty discerning that there is a repeating pattern at all, especially since in the embodiment shown the pillar slabs 2 each simulate two courses of a natural stone pillar. The general appearance of the finished pillar is therefore effectively random along any one face and patterns are prevented from repeating in a noticeable way, avoiding a "manufactured" look.

It will be appreciated that the specific placement of vertical joints 22 is a matter of selection, bearing in mind that the vertical joints 22 visually define the side boundaries of the stone faces 20, and the aesthetic object of creating a natural finish. The natural look is achieved as long as at least two side surfaces of the pillar slab 2 have vertical joints 22 disposed in different horizontal positions, so that when the two different side surfaces are stacked one on the other, the vertical joints 22 are out of alignment.

As can be seen in FIGS. 1 to 6, in the preferred embodiment shown the body 10 is slightly raised above the top-most edges of the stone faces 20, by the distance of a horizontal joint 24. This provides the appearance of a horizontal joint 24 traversing the width of each side surface when one pillar slab 2 is stacked on another, as best seen in FIG. 8, providing continuity in the look of a natural stone construction along the height of the finished pillar.

Means may be provided to assist in properly lining up the pillar slabs 2 for stacking, and maintaining pillar slabs 2 in the properly stacked position in the finished pillar, such as ribs, bosses or other projections (not shown) in one of the top or bottom surface of the body 10, cooperating with complementary recesses (not shown) in the other of the top or bottom surface of the body 10, to maintain alignment between adjacent pillar slabs 2.

In the preferred embodiment the body 10 comprises a hollow core, in the embodiment shown formed by a vertical opening 26 through generally the centre of the body 10 and defined by a core wall 28. The core wall 28 tapers slightly, converging toward the bottom of the pillar slab 2, which facilitates removal of the pillar slab 2 from the mold 40.

The hollow core is optional, but provides a number of advantages. The hollow core reduces the weight of the pillar slab 2, making it easier to manoeuvre. The hollow core also reduces the amount of concrete required to cast the pillar slab 2, thereby reducing the cost of manufacture. Further, the openings 26 are aligned in vertically adjacent pillar slabs 2, creating a raceway (best seen in FIG. 8) that can be used for running conduit for a gas supply, electrical cable etc., for example where a lamp or lantern (not shown) is mounted on the pillar.

Figure 14:
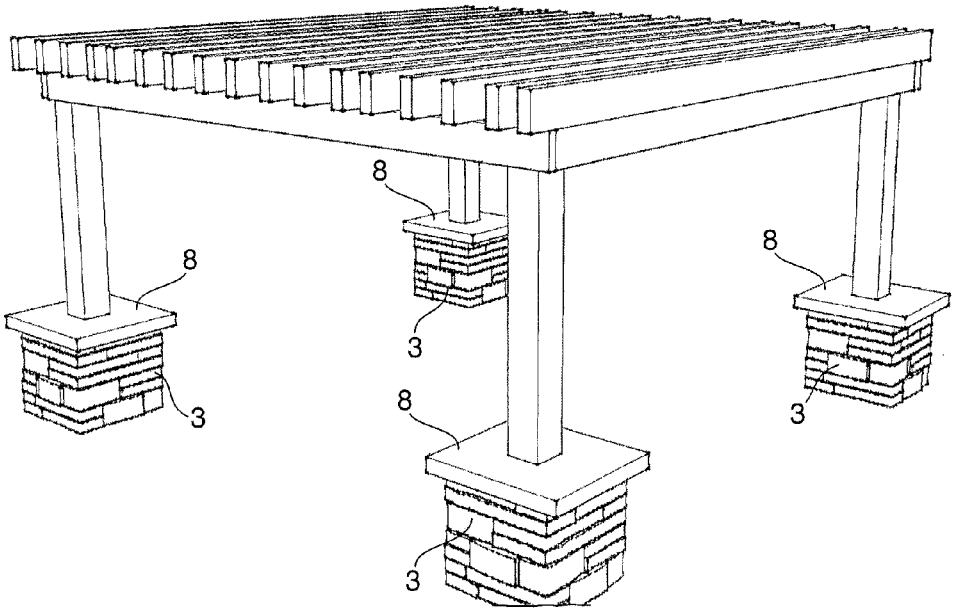
FIG. 14 is a perspective view of finished pergolas constructed around existing posts supporting a raised wood deck frame, using the pillar slab of FIG. 1.

The hollow core also permits the construction of a pillar around an existing structural member such as a post, for example a post 4 supporting a raised deck as illustrated in FIG. 14. The opening 26 is preferably large enough to fit around a standard vertical support, such as a 6×6 or 8×8 wooden post or concrete pier (not shown), but not so large as to reduce the structural integrity of the pillar slab 2. This is beneficial for the construction of pergolas 3, fences 6 and other structures in which the post is required (or desired) to be covered for aesthetic reasons.

In the preferred embodiment the vertical joints 22 on at least one side surface 12 are spaced apart for cutting out a portion 30 of the pillar slab 2 of a selected size, in order to accommodate the integration of other elements. In the embodiment illustrated side surface 12 has vertical joints 22' equally spaced from the ends of the pillar slab 2 which visually define a stone face 20 of the desired cut-out width. In the embodiment illustrated, the width between the vertical joints 22' is the width of a standard 10" (250 mm) companion wall unit. Guide lines 33 may be provided along the top of the body 10, in alignment with the vertical joints 22', to assist in cutting the pillar slab 2 at the appropriate positions.

Figure 11:
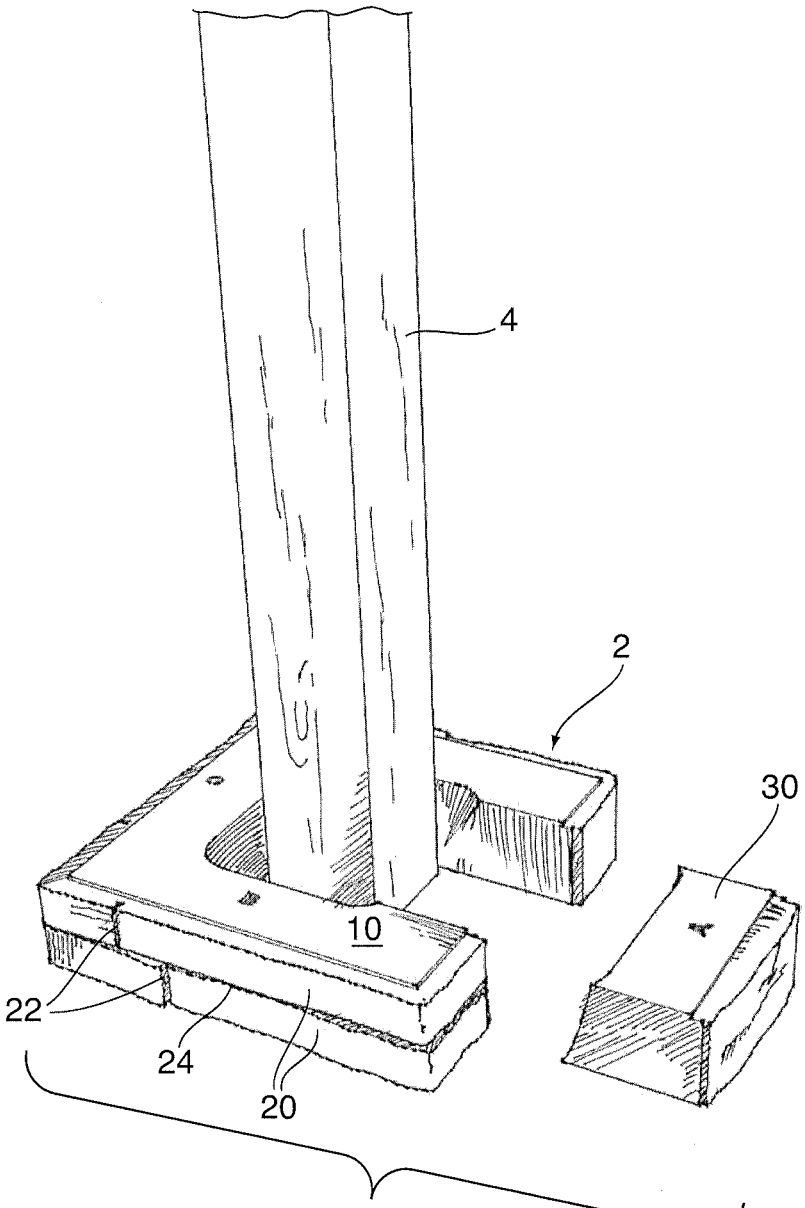
FIG. 11 is a perspective view of a pillar slab of FIG. 1 with a side portion cut out of one side, for laying the pillar slab around an existing post.
Figure 12:
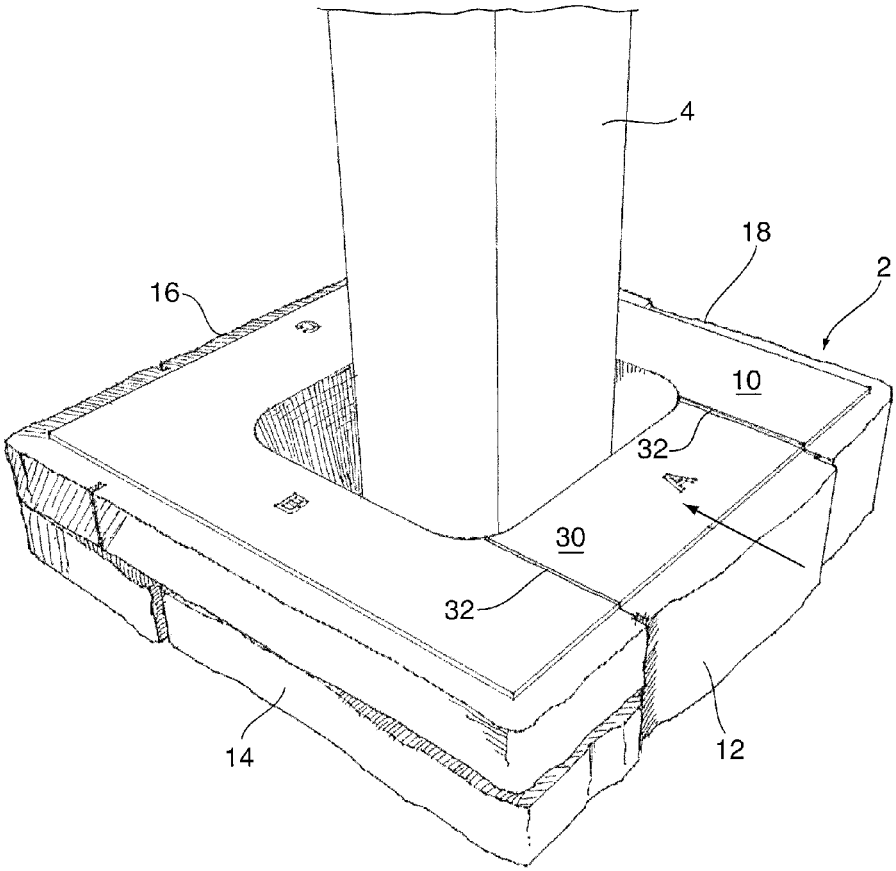
FIG. 12 is a perspective view of the pillar slab of FIG. 11 with the cut-out portion replaced to reconstruct the pillar slab.
Figure 13:
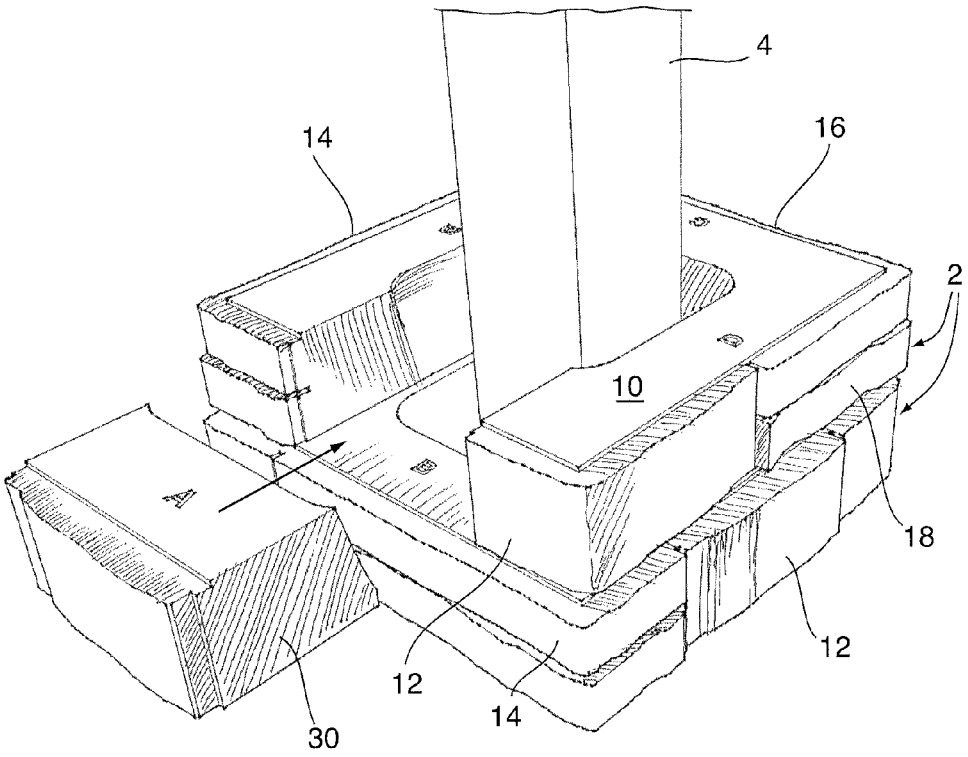
FIG. 13 is a perspective view of the pillar slab of FIG. 11 having an upper course with a portion cut out of one side, laid over the lower course.

By cutting straight along the line of the joints 22' toward the core wall 28, the portion 30 can be removed, as shown in FIG. 11, without disturbing the texture of the stone face 20 so that the natural look of the stone face 20 remains intact (cutting into wet cast concrete that is formed to simulate a natural stone texture would expose concrete aggregate, thereby destroying the natural appearance). Positioning the two vertical joints 22 where the portion 30 should be cut also helps to conceal the cut lines 32 when the portion 30 is replaced, as shown in FIG. 12. The cut lines 32 can be filled with grout or mortar, which will seal along the floor 23 of the joints 22, rendering the cut lines 32 virtually invisible in the finished pergola.

In the case of an existing post 4, such as for a pergola, the removal of the cut-out portion 30 of the pillar slab 2 creates a horizontal opening that allows the pillar slab 2 to be positioned around the post 4, as shown in FIG. 11. The cut-out portion 30 of the pillar slab 2 is then replaced, as shown in FIG. 12, to complete the course. For subsequent (higher) courses, the cut-out portion 30 of the pillar slab 2 is removed the same way, but the pillar slab 2 is rotated 90 degrees to change the side surface alignment. FIG. 14 shows an elevated deck structure, as an example of typical application for this aspect of the invention.

Figure 15:
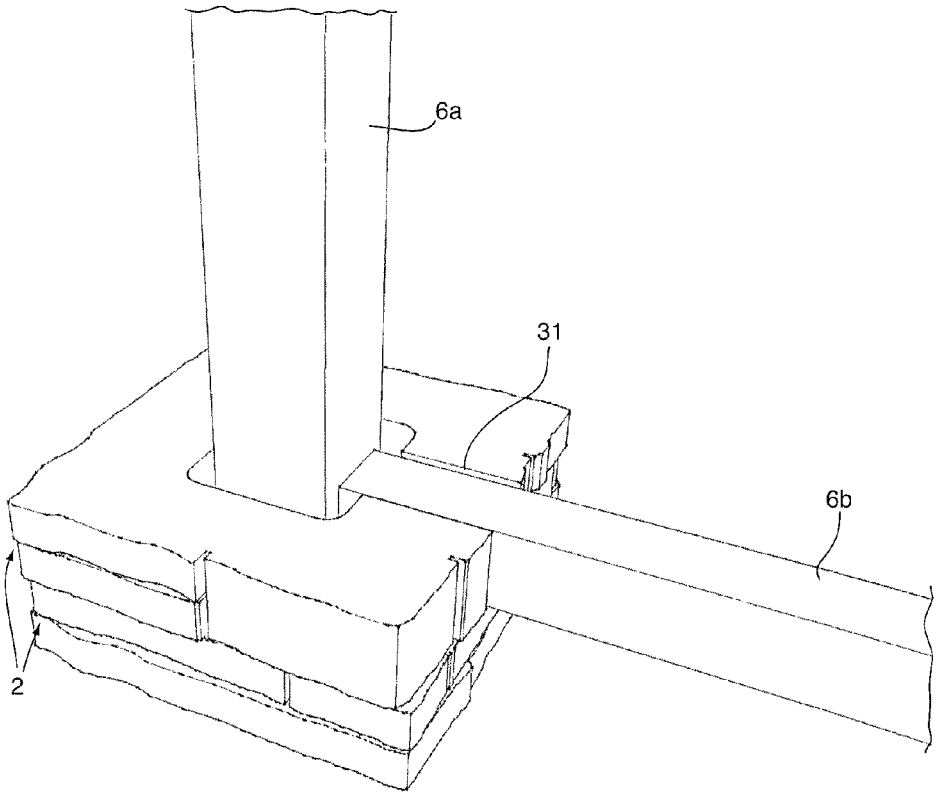
FIG. 15 is a perspective view of a partially constructed pillar with a side portion cut out from one side of a pillar slab for inserting the bottom rail of a wood fence.
Figure 16:
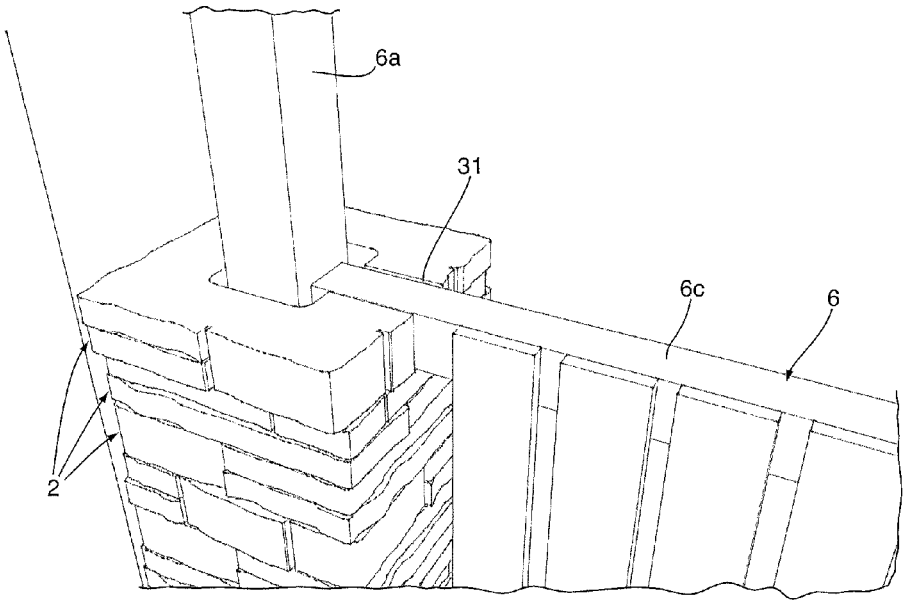
FIG. 16 is a perspective view of the pillar of FIG. 15 with a side portion cut out from one side of a pillar slab for inserting the top rail of a wood fence.
Figure 17:
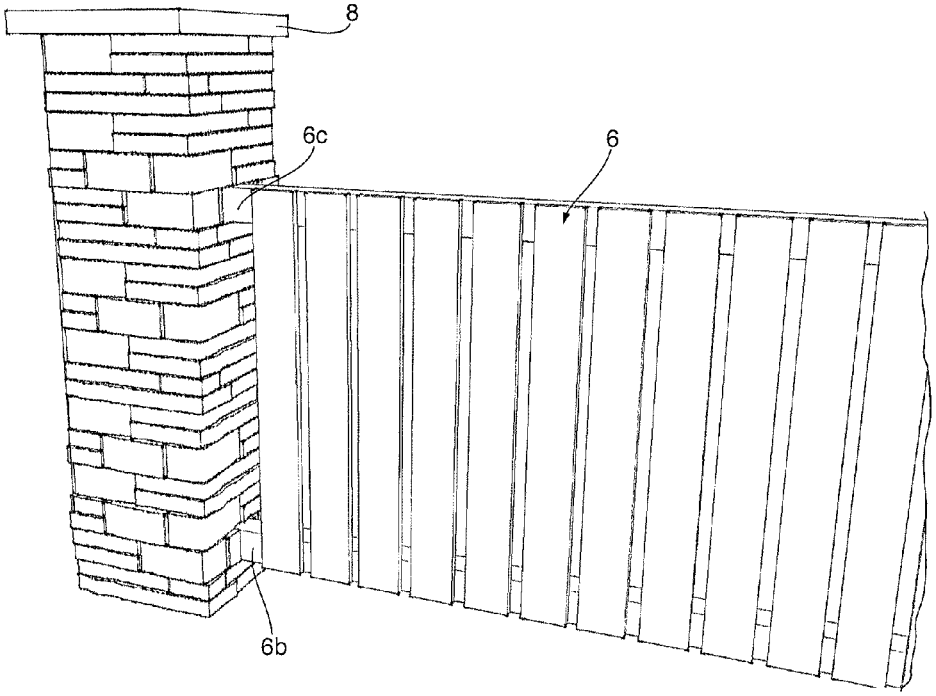
FIG. 17 is a perspective view of the finished pillar of FIGS. 15 and 16.

In some applications the cut-out portion does not need to be replaced, or example in the case of an end post **6*a* for a fence 6. As shown in FIG. 15 the pillar slab 2 can be cut to create a horizontal opening that fits the width of a structural element, for example a fence rail, and dropped down over the top of the end post 6*a*. The cut-out portion (not shown) is not replaced since the void in the pillar slab 2 is taken up by the fence rail, for example the bottom rail 6*b* as shown in FIG. 15. In this case, the pillar slab 2 may be cut at any desired position (preferably one that provides opening into the hollow core) without concern for exposing the concrete aggregate. Subsequent courses are stacked as described above in the case of the pergola, each being rotated by 90 degrees relative to the immediately adjacent pillar slab 2, until the height of the top rail 6*c* is reached. A portion is cut out of the pillar slab 2 at that height to allow for the width of the top rail 16*c*, as shown in FIG. 16. Further pillar slabs 2 are then stacked, in different orientations in accordance with the invention, until the desired height of the pillar is reached and topped with a cap or coping element 8, as shown in FIG. 17**.

FIGS. 15 and 16 illustrate an application of the pillar slab 2 of the invention for supporting a fence 6. An end post **6*a* is erected in conventional fashion and a bottom pillar slab 2 is inserted around the post 6*a*. The next higher pillar slab 2 has a portion approximating the width of the bottom rail 6*b* cut out to produce an entry opening 31 into which the bottom rail 6*b* is inserted, supported on the bottom pillar slab 2. The pillar is constructed as described above, with each successive pillar slab 2 being oriented and inserted over the end post 6*a*, until the height of the fence 6 is reached. The next higher pillar slab 2 has a portion approximating the width of the top rail 6*c* cut out to produce an opening 31 into which the top rail 6*c* is inserted, as shown in FIG. 16, and successive pillar slabs 2 are added, and typically topped with a cap or coping element 8, to produce the finished pillar shown in FIG. 17**.

Figure 18:
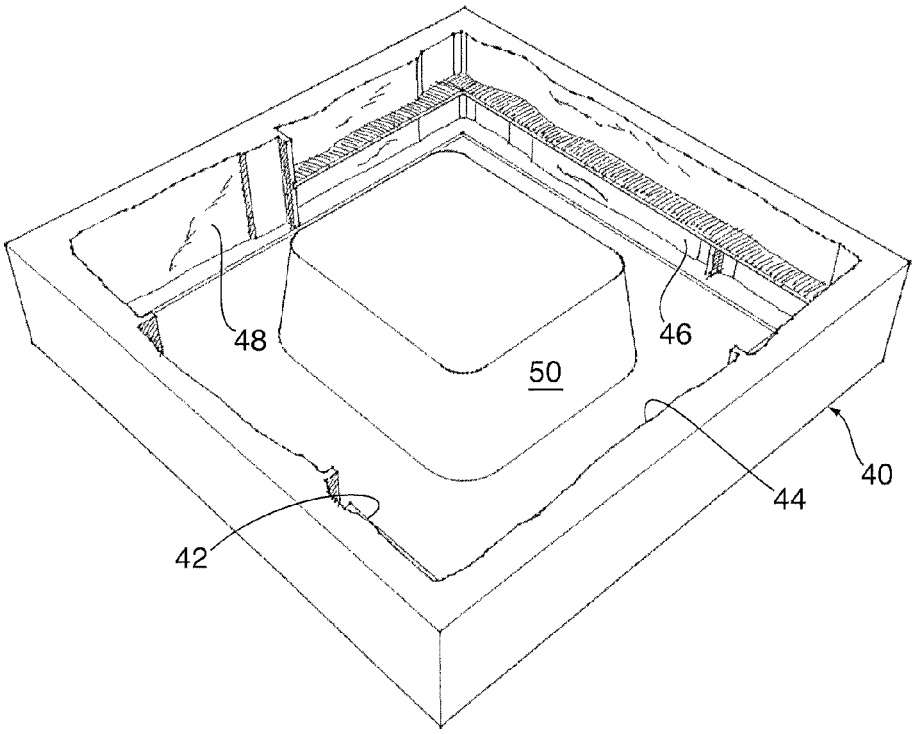
FIG. 18 is a top perspective view of a mold for forming the pillar slab of FIG. 1.

A mold 40 for producing the pillar slab 2 illustrated in FIGS. 1 to 7 is illustrated in FIG. 18. The mold 40 may be manufactured from any suitable flexible material, preferably rubber or polyurethane, which provide long term flexibility and resistance to wear and tear. The mold 40 is essentially the "negative" of the pillar slab, comprising walls 42, 44, 46 and 48 each having an internal profile for forming the stone faces 20 and joints 22, 24 over respective sides 12, 14, 16 and 18 of the pillar slab 2, and a centre block 50 for forming the opening 26 through the centre of the pillar slab 2. In use, concrete is poured into the mold 40 and allowed to set, and the mold 40 is peeled off to release the pillar slab 2.

Figure 19:
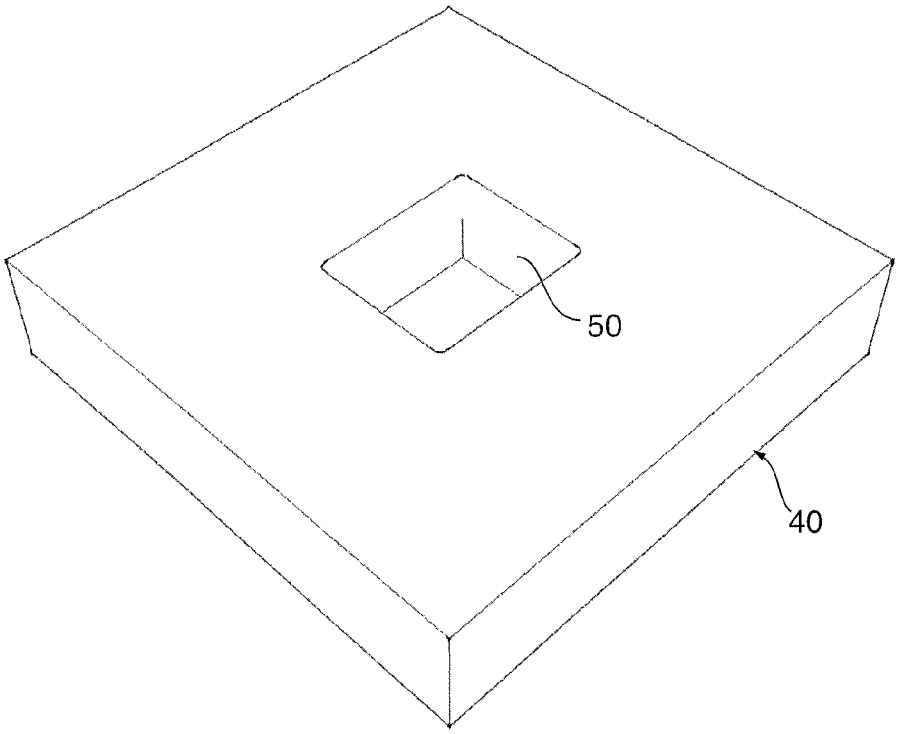
FIG. 19 is a bottom perspective view of the mold of FIG. 18.

The mold design must therefore also consider the demolding of the cured concrete pillar slab 2. Preferably the block 50 is hollow, as shown in FIG. 19, which allows the protuberance 50 to partially collapse during demolding of the pillar slab 2, to assist in releasing the pillar slab 2 from the mold 40. The lateral and vertical protrusions in the mold 40 that form the joints 22, 24 will tend to resist the demolding process, because they are inset into the cured pillar slab 2. This requires a balance between limiting joint depth to allow for proper demolding (limiting the joint depth also limits the resistance generated by the protrusion when demolded), while ensuring that the joint depth is sufficient to create the illusion of a real joint. It has been found that maintaining joint widths to within the range of typical stone masonry construction (5 mm-8 mm), and using a 2:1 ratio of joint depth to width as described below, achieves a balance between the competing considerations of limiting the joint depth for demolding while creating a visually pleasing and natural appearance in the finished pillar.

The design of the simulated joints 22 within the side surfaces 12, 14, 16, 18 of the pillar slab 2 is an important factor in creating the illusion of many smaller separate stones forming a natural stone pillar. To appear real, the joints 22 must be made with sufficient depth, relative to the width of the joint, to create a dark shadow and thus as much as possible conceal the joint floor 23 (which is the only part of the body 10 of the pillar slab 2 that is visually exposed in the finished pillar). Ideally the joint depth should be substantially greater than the joint width to create this shadow effect. However, the joints 22 are created by positive protrusions from the interior sides of the mold 40, whether vertical (to create joints 22) or horizontal (to create joints 24), with dimensions equal to the desired joint size. Since the mold 40 used to create the pillar slab 2 is flexible, if the protrusions within the mold 40 that create the joints 22, 24 are too slender they will tear over time and render an expensive mold useless. As such, a balance must be struck between providing sufficient slenderness to the joint 22 to create the desired shadowing and give the illusion of a natural joint, while ensuring that the flexible protrusion which creates the joint will maintain its structural integrity within the mold 40 over time.

Figure 20:
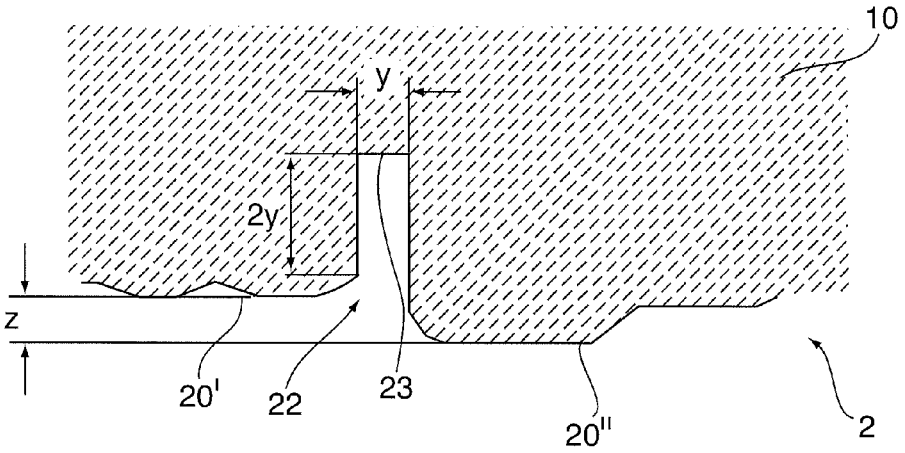
FIG. 20 is an enlarged cross-section of adjacent simulated stone faces formed in a shelved configuration.

It has been found that a ratio of joint depth to joint width equal to approximately 2:1, as shown in FIG. 20, provides a good balance between these competing parameters. Accordingly, in preferred embodiments, at the point where the end of a stone face 20 is defined by a joint 22 the stone face 22 protrudes from the body 10 by a distance which is at least twice the width y of the joint 22.

In addition to using the 2:1 ratio of joint depth to width, for vertical joints 22, it is advantageous to use a "shelving" effect, illustrated in FIG. 20, whereby the stone face 20" on one side of the joint 22 protrudes further than the stone face 20' on the other side of the joint 22. This creates a shadow along the outer extremity of the joint 22, in addition to the shadow along the floor 23 of the joint 22 created by the selected depth-to-width ratio. Although optional, these features will generally result in shadow effects that obscure the floor 23 of the joint 22, adding to the realism of the appearance of the finished pillar.

Figure 21:
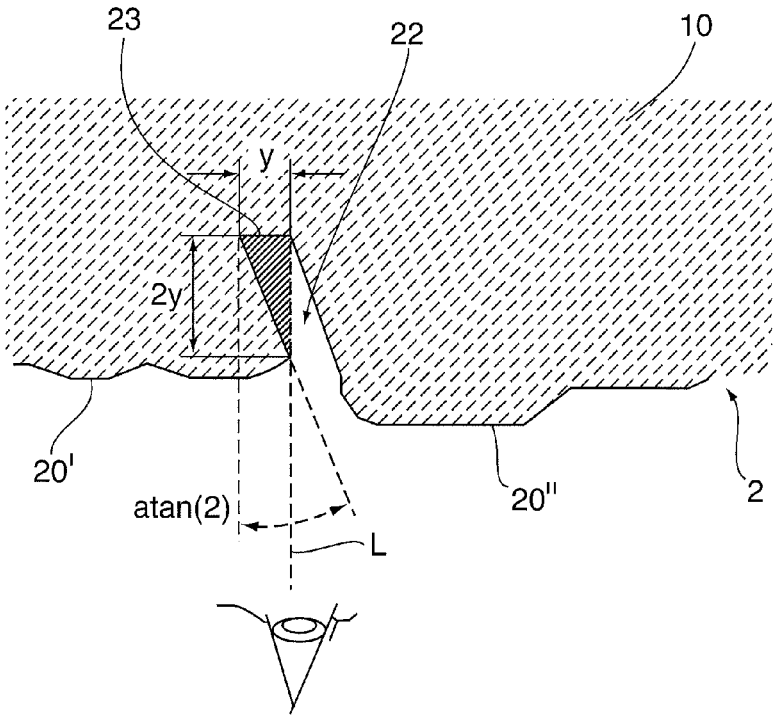
FIG. 21 is an enlarged cross-section of an oblique simulated joint.

Another technique that can be used to add a shadow effect along the floor 23 of a vertical joint 22 is to angle the joint 22 obliquely along its depth (i.e. toward the body 10), as shown in FIG. 21. Using the illustrated 2:1 ratio of joint depth to joint width as an example, if the joint 22 is angled off-square as a function of this ratio, the stone face 20 on of the joint 22 can be used to block the viewer's line of site to the floor 23 of the joint 22. In the example shown in FIG. 21, the angle may be the inverse tangent (a tan) of the ratio of depth to width, in the example shown the number 2. Using this angle of 26.5 degrees from a plane orthogonal to the side surface, the entire floor 23 of the joint 22 is concealed from a line of site L perpendicular to the pillar face and intersecting the joint 22.

The pillar slab 2 can be cut into sections for constructing a self-standing fireplace 60 with a chimney 80, suitable for indoor or outdoor use, as illustrated in FIGS. 22A to 22F. In this application a plurality of pillar slabs 2 are cut in half transversely, in different directions. Some pillar slabs 2 are cut though opposing exterior side surfaces 12 and 16 (i.e. through the letters "A" and "C" in FIG. 1), leaving exterior side surfaces 14 and 18 intact; and other pillar slabs 2 are cut though opposing exterior side surfaces 14 and 18 (i.e. through the letters "B" and "D" in FIG. 1), leaving exterior side surfaces 12 and 16 intact. In the preferred embodiment of the invention, in which all of the exterior side surfaces 12, 14, 16 and 18 have different patterns of simulated stone faces, this creates four different of half pillar slabs 2' each having an uncut exterior side surface that varies from the uncut exterior side surfaces of the other three half pillar slabs 2'.

Figure 22A:
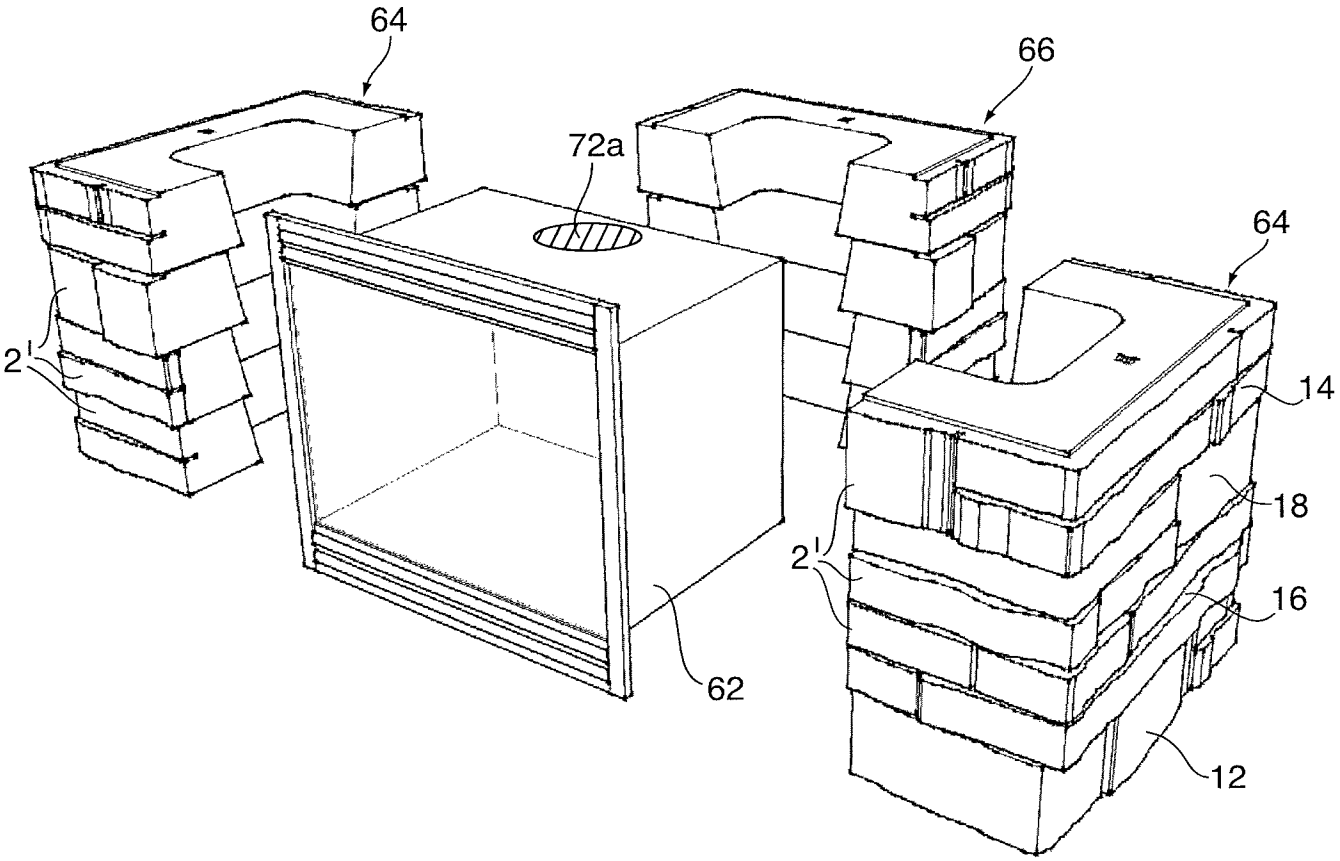
FIGS. 22A to 22F are perspective views of the stages of construction of a fireplace utilizing a pillar slab according to the invention.

The half pillar slabs 12' are stacked, as described above, so that different side surfaces are vertically adjacent to one another. For example, the column of half pillar slabs 12' at the right-hand side of FIG. 22A is formed with uncut exterior surfaces 12, 16, 18, 14 stacked in order from bottom to top. Thus, the same pattern will repeat only every fifth half pillar slab 2', as in some of the previous embodiments, making it difficult to detect any repeating patterns.

Figure 22B:
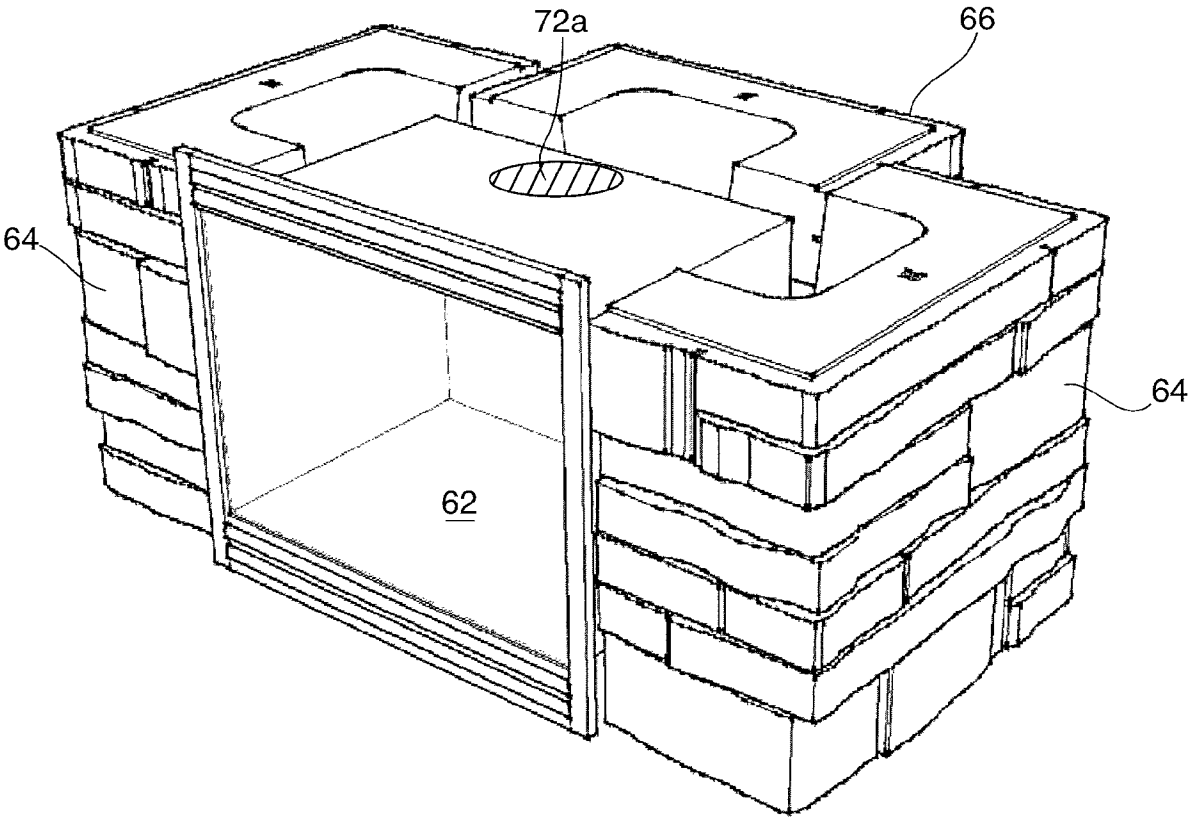
Figure 22C:
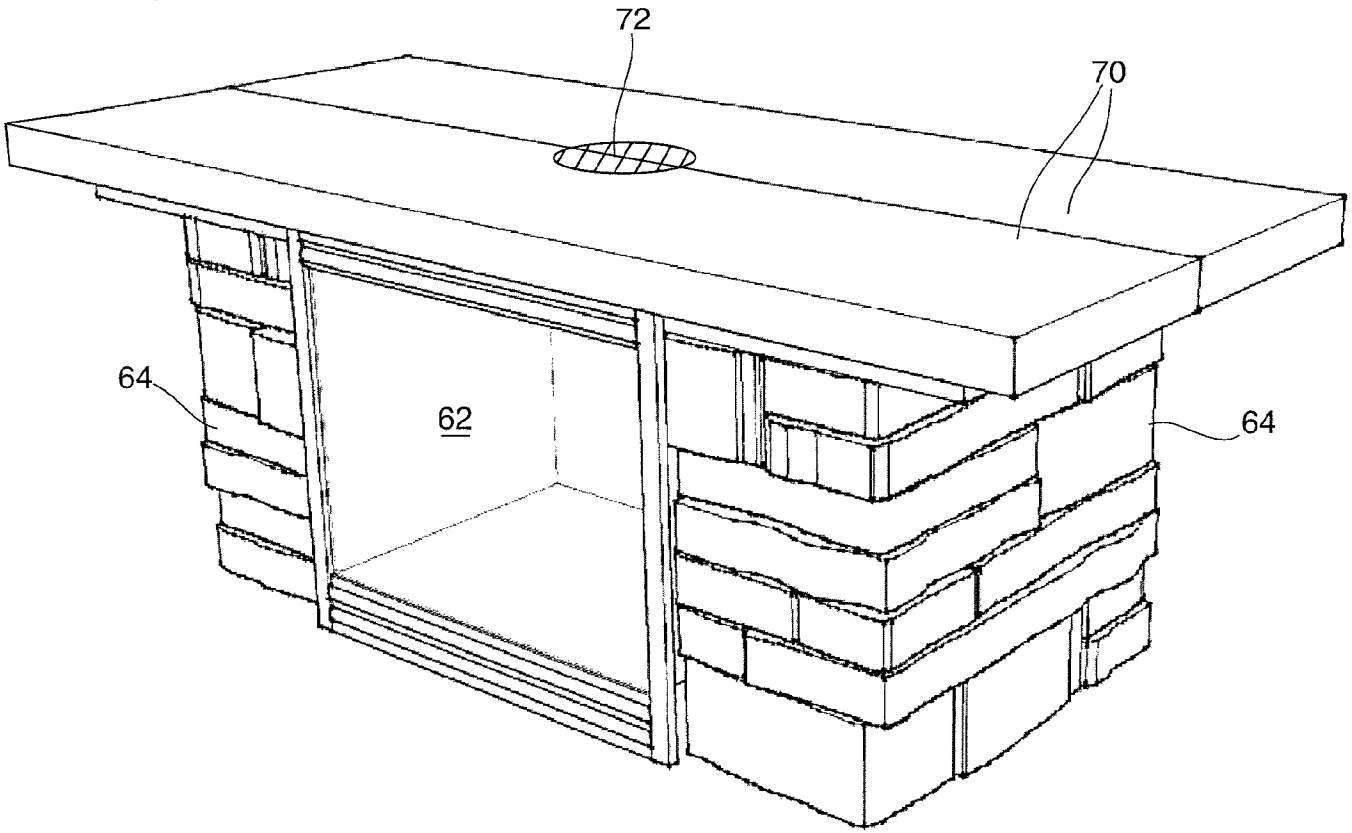
Figure 22D:
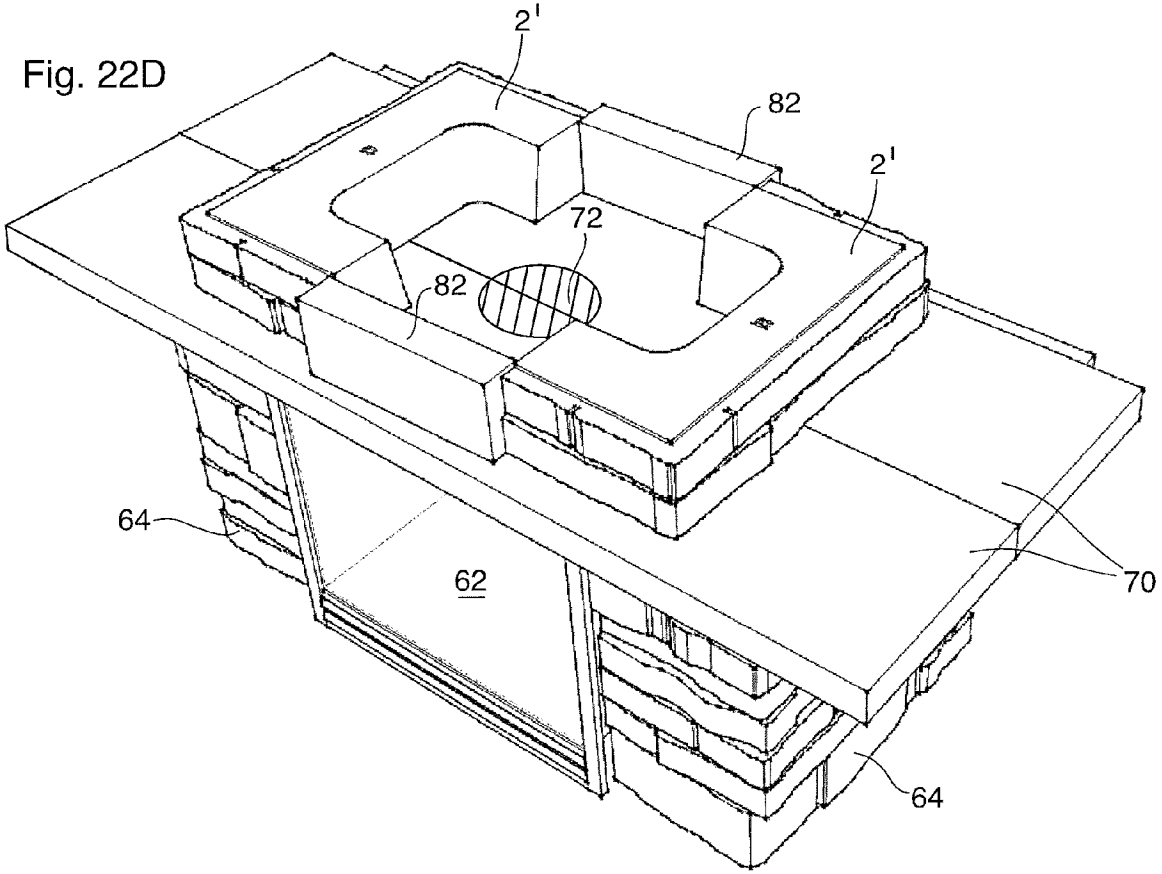

Two side columns 64 and one back column 66 of half pillar slabs 2' are fitted to a fireplace liner 62 to create a fireplace 60 as shown in FIG. 22B. The fireplace 60 can be built around any suitable fireproof enclosure, a prefabricated metal fireplace liner 62 being illustrated solely by way of example. One or more slabs 70 may be laid over the fireplace, as shown in FIG. 22C, concealing the open cores of the half pillar slabs 2' and optionally providing a mantle. The slabs 70 may be formed from natural stone such as marble or granite, or prefabricated from concrete to a suitable thickness. A chimney flue 72 cut through the slabs 70 is in communication with the interior of the fireplace liner 62 via liner flue port 72*a*.

Figure 22E:
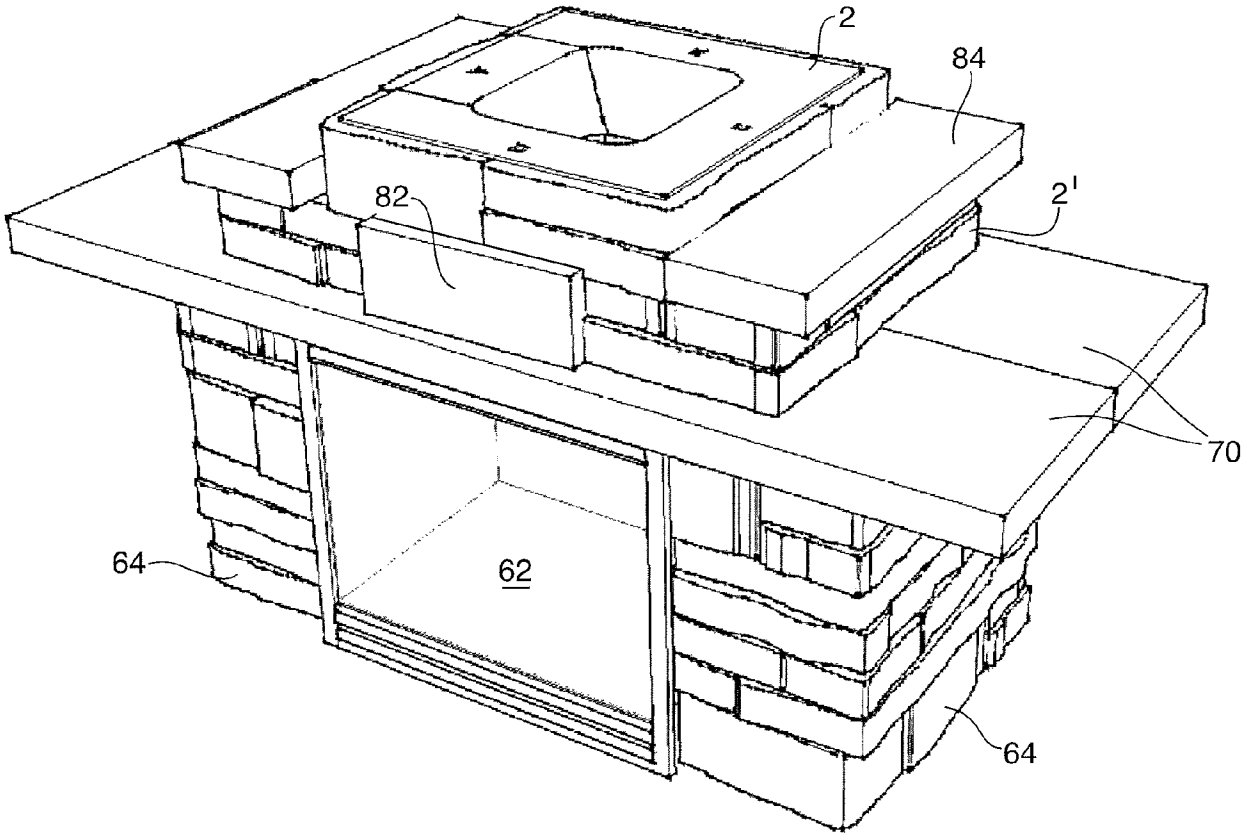
Figure 22F:
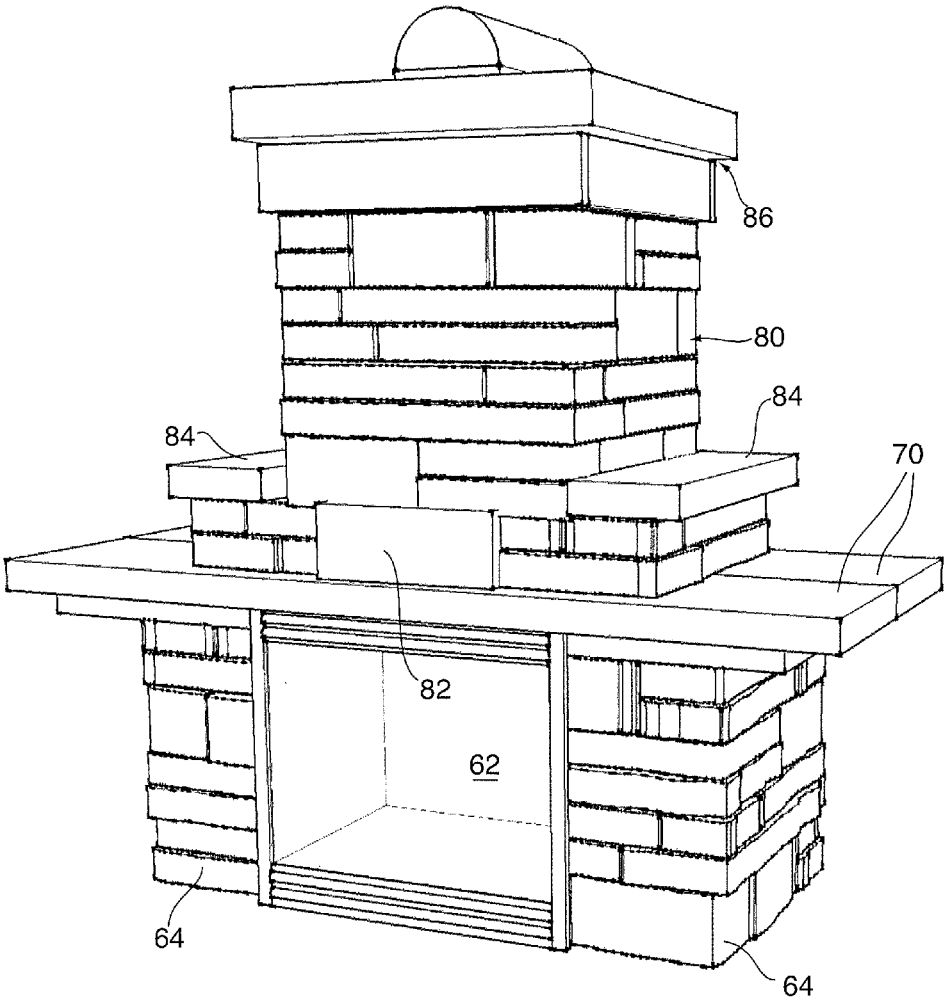

A chimney 80 may be constructed to any desired size, either with simple uniform dimensions or with complex designs such as that shown in FIG. 22F, using any combination of pillar slabs 2, half pillar slabs 2', filler blocks 82 and shelf slabs 84. In the embodiment illustrated a base chimney layer is formed from two half pillar slabs 2' spaced apart to provide the desired chimney width, with filler blocks 82 filling the exterior opening between the cut ends of the half pillar slabs 2', as shown in FIG. 2D. In the next layer a pillar slab 2 is centred over the base layer and shelf slabs 84 are laid on either side, as shown in FIG. 22E.

The chimney 80 is completed by stacking pillar slabs 2 to the desired height, preferably in the manner described above in order to avoid obvious repeating patterns. The top of the chimney 80 may be capped with a mortar crown 86 or any other suitable finishing element. For indoor applications the hollow core of the stacked pillar slabs 2 in the chimney 80 can serve as a raceway for a suitable chimney liner (not shown), to contain and expel flue gases from the structure.

Various embodiments of the present invention having been thus described in detail by way of example, it will be apparent to those skilled in the art that variations and modifications may be made without departing from the invention. The invention includes all such variations and modifications as fall within the scope of the appended claims.

RELATED APPLICATION

The present application claims priority benefit of Canadian application serial number 2829672 filed on 7 Oct. 2013 entitled "Prefabricated Pillar Slab System and Mold for Manufacturing A Prefabricated Pillar Slab," which is hereby incorporated herein by reference in its entirety.

The invention claimed is:

1. A method of constructing a pillar around a post from pillar slabs, each pillar slab comprising a body comprising at least four sides and a hollow core, each side comprising an exterior side surface, each exterior side surface comprising at least one simulated stone face, at least one of the four sides having an exterior surface comprising at least two simulated vertical joints positioned to visually define at least one simulated stone face, a removable portion of the at least one of the four sides defined between the at least two simulated vertical joints, comprising the steps of:

a. cutting through the at least two simulated vertical joints to the hollow core;

b. removing the removable portion to create an opening sized to receive the post;

c. disposing the pillar slab around the post; and d. replacing the removable portion.

2. The method of claim 1 wherein the removable portion is aligned with edges of the hollow core.

3. The method of claim 1 wherein the pillar slabs are substantially identical.

4. The method of claim 3 wherein step c. comprises laying the pillar slab over another pillar slab in rotationally different orientations.

5. The method of claim 4 wherein the simulated vertical joints in at least two side surfaces of the pillar slab and the another pillar slab are laterally staggered relative to one another so that side surfaces of the pillar have different arrangements of simulated stone faces.

6. The method of claim 1 wherein the simulated stone face on one side of the vertical joint projects from the body more than the simulated stone face on the other side of the vertical joint.

7. The method of claim 1 wherein at least one vertical joint in at least one of the exterior side surfaces is disposed off-square relative to said exterior side surface.

8. The method of claim 1 wherein at least one of the exterior side surfaces of the body comprises a simulated stone face having one simulated course of stone and a simulated stone face having plural simulated courses of stone.

9. The method of claim 1 wherein the at least two simulated vertical joints defining the at least one simulated stone face are aligned with edges of the hollow core.

10. The method of claim 1 further comprising, at any time, the sub-steps of i) cutting a horizontal opening at least partially through one of the pillar slab bodies, and ii) inserting a structural member into the horizontal opening, the structural member being supported by another of the pillar slabs.

* * * * *